US005808235A

United States Patent [19]

Burton

[11] Patent Number: 5,808,235

[45] Date of Patent: Sep. 15, 1998

[54] ELECTRICAL RESISTANCE REMOVAL APPARATUS AND METHOD

[75] Inventor: Marion B. Burton, St. Augustine, Fla.

[73] Assignee: Save-A-System, Inc., St. Augustine, Fla.

[21] Appl. No.: 691,383

[22] Filed: Aug. 2, 1996

Related U.S. Application Data

[63] Continuation-in-part of Ser. No. 352,356, Dec. 9, 1994, abandoned.

[51] Int. Cl.[6] ..... H01R 4/66

[52] U.S. Cl. ..... 174/6

[58] Field of Search ..... 174/2, 3, 5 R, 174/55 B, 55 G, 6, 7

[56] References Cited

U.S. PATENT DOCUMENTS

| | | | |
|---|---|---|---|
| 286,086 | 10/1883 | Spang | 174/2 |
| 688,855 | 12/1901 | Immich | 174/6 |
| 852,548 | 5/1907 | Finn | 174/2 |
| 2,053,214 | 9/1936 | Brown | 174/7 |
| 2,579,139 | 12/1951 | Chipley | 174/7 |
| 2,739,998 | 3/1956 | Kretzer | 174/6 |
| 4,361,719 | 11/1982 | Hyde | 174/6 |

FOREIGN PATENT DOCUMENTS

| | | | |
|---|---|---|---|
| 2275037 | 2/1976 | France . | |
| 52-21655 | 2/1977 | Japan | 174/6 |
| 52-50552 | 4/1977 | Japan | 174/6 |
| 0904042 | 2/1982 | Suriname | 174/6 |
| 664252 | 5/1979 | U.S.S.R. . | |

OTHER PUBLICATIONS

IEEE Transactions on Power Apparatus and Systems. vol. PAS–97, Nov. 5, Sep./Oct. 1978, pp. 1760–1768.

*Primary Examiner*—Hyung S. Sough
*Attorney, Agent, or Firm*—Alan L. Crawford

[57] ABSTRACT

An electrical resistance removal apparatus and method having a plurality of electrically conductive ground wires attached to a common junction on a stranded electrical ground wire of a building. The plurality of ground wires are attached to electrically conductive rods embedded in the earth. The ground wires are spaced apart a selected distance, preferably two inches, from each other. The ground rods are spaced apart a selected distance from each other, preferably fourteen inches.

6 Claims, 1 Drawing Sheet

ELECTRICAL RESISTANCE REMOVAL APPARATUS AND METHOD

This application is a continuation in part of application Ser. No. 08/352,356, filed Dec. 9, 1994 and now abandoned.

BACKGROUND OF THE INVENTION

The invention is related to electrical grounding systems and more particularly to an apparatus and a method for protecting and removing resistance from electrical circuitry in residential and commercial buildings.

Electrical equipment in residential and commercial buildings rely on a solid earth ground for operation and for safety of personnel operating such equipment.

Without such solid earth ground, electrical circuits in the electrical equipment encounter many problems due to excessive resistance in an electrical wiring. Often the excessive resistance in the electrical wiring causes the lighting in the house to be dimmer than it should be. Furthermore, electrical appliances do not run properly and do not last as long as they would otherwise. Moreover, the high electrical resistance in the electrical wiring results in more electricity being used and higher electric bills for the consumer. Also, electrical power spikes caused by power fluctuations or lightening strikes can damage or destroy appliances. Thus, a need exists for an apparatus and method that will help eliminate the above problems.

The prior art contains some apparatus that have attempted to solve some of these problems.

The Brown patent teaches an electrode resistant to anodic attack that uses spaced rods connected to wires which are in turn connected to the AC supply of a house or a pipe. It requires that rods be buried in a porous material. The Soviet patent (SU 664,252) teaches placing spaced electrodes in the ground, one on each side of a conductor to lower the system resistance and costs of electrical transmission, but it does not use rods. The Chipley patent teaches a ground for a telephone box consisting of a rod buried in the earth which is connected by a wire to the box. The IEEE Publication teaches the use of a grounding grid which does use copper rods to achieve lower resistance in electric generation transmission, but it would appear to have an arcing problem. The Hyde patent teaches a grounding system for both household and commercial use having a wire extending from a utility box to a lug ground attached to the foundation. The French patent discloses a grounding connection in which a wire is connected to a side of a long, buried pointed rod. The Kretzer patent shows a grounding device for lightning protection which uses buried rods. The Immich patent teaches another ground for lightning which uses a wire connected to a series of buried metal plates. Finally, the Finn patent teaches using a series of wires connected to buried rods to serve as a lightning conductor.

In addition to the above patented art, current electrical wiring systems do use single grounds to protect the electrical systems, but such are not effective in removing resistance or in protecting appliances from power surges or lightning.

As described in further detail hereafter, the present invention provides a new grounding apparatus and method that removes most resistance from electrical wiring in buildings and solves the above problems.

SUMMARY OF THE INVENTION

The primary object of the present invention is to provide an apparatus and method to reduce resistance from the electrical wiring of residential and commercial buildings to help protect appliances and electrical devices including telephone and computer lines from damage due to power surges and lightning.

Another object of the present invention is to provide such an apparatus and method to increase the life of appliances and electrical devices.

A further object of the present invention is to provide such an apparatus and method that reduces electrical usage and thus, electrical costs, by reducing the amperage necessary for running lights, appliances and other electrical devices.

The present invention fulfills the above and other objects by providing an apparatus having a plurality of ground wires attached at a common junction to an electrical ground for an electrical inlet of a building which are attached to an equal number of ground rods placed into the earth and spaced apart a select distance from each other. The ground wires are also spaced apart a select distance from each other between the common junction and the ground rods. The preferred number of ground wires and ground rods is four. The preferred select distance between rods is fourteen inches. The arrangement of the ground wires have a parallel portion and angled portion. The preferred select distance between ground wires of the parallel portion is two inches. The two inch distance between ground wires is begun 8 inches from a standard building ground when an angled outside ground wires reach a distance of six inches apart, from which they are then arranged in the parallel fashion to the farthest ground rod. Although the ground wires and ground rods may be made of any highly electrically conductive material, copper is a preferred material.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PREFERRED EMBODIMENT

Figure 1:
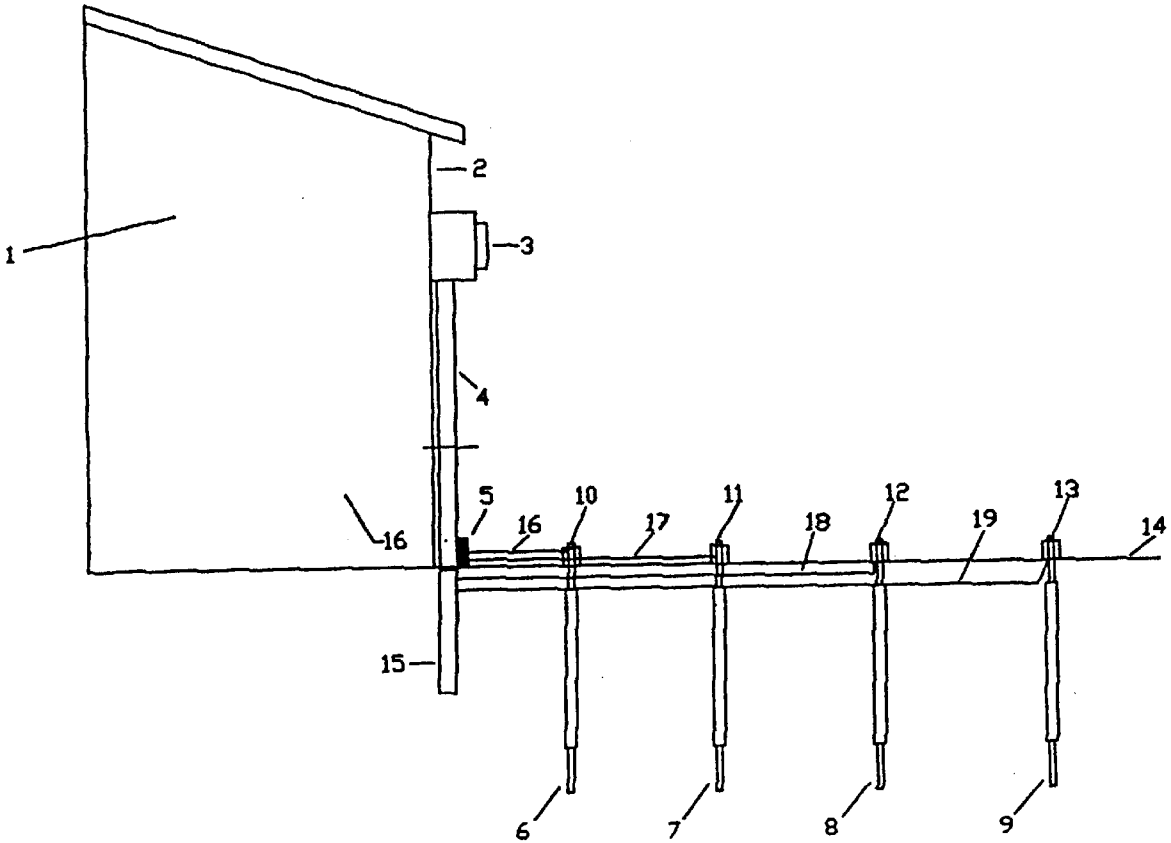
FIG. 1 is a side view showing the apparatus as it would appear installed in residential and commercial use.

Referring to the drawings, in FIG. 1 an electric meter 3 is shown attached to the wall 2 of a building 1. The standard ground wire 4 is attached to the electrical meter 3 and embedded in the ground 14 to a standard ground rod 15. The apparatus claimed by this invention starts at a soldered common junction 5 which has four electrically conductive ground wire s 16, 17, 18 and 19 extending from the common junction. Each ground wire is connected to ground rods embedded vertically in the ground 14. Those ground rods being 6 for ground wire 16, 7 for ground wire 17, 8 for ground wire 18 and 9 for ground wire 19. As shown, each of the ground wires may be connected to the top of the ground rods by clamps 10, 11, 12, and 13, respectively. The ground rods 6, 7, 8, and 9 have a preferred select distance of fourteen inches between them.

Figure 2:
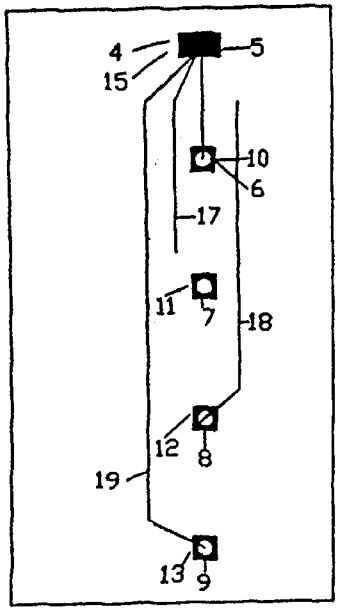
FIG. 2 is a top partial view of the apparatus.

In FIG. 2, the common junction 5 which is soldered to the standard ground wire 4 and a standard ground rod 15 has ground wires 16, 17, 18 and 19 extending from same, each connected to the ground rods 6, 7, 8 and 9, respectively. The space between each of the wires 16, 17, 18 and 19 is at least two inches at the parallel portion of grounding wires which begins 8 inches from the soldered common junction 5 so as to prevent arcing between the wires when removing resistance from electrical wiring or during electrical strikes. The preferred distance between the ground rod 6 and the soldered common junction 5 as well as each of the ground rods 6, 7, 8 and 9 has a select distance of fourteen inches between them, so as to prevent arcing and to assure adequate space for electrical discharge of power surges into the earth 14.

Although the grounding wires and rods may be made of any highly conductive material, they would preferably be made of highly conductive metal, such as copper. It has been found to be important that there be two inches between each ground wires at the parallel portion and fourteen inches between each ground rod as well as the ground rod 6 and the soldered common junction 5 to achieve optimum performance of the apparatus. All the grounding wires must be soldered to a common junction extending from the standard ground wire of the building leading from the electrical meter in order to prevent corrosion.

Although only one preferred embodiment of the present invention has been described in detail hereinabove, all improvements and modifications to this invention within the scope or equivalents of the claims are included in this invention.

I claim:

1. An apparatus for reducing resistance in an electrical system comprising:

a plurality of electrically conductive ground wires having a common junction adapted to be attached to an electrical ground of an electrical meter of a building and having a parallel portion and angled portions and a selected distance between said ground wires of said parallel portion being two inches; and an equal number of electrically conductive ground rods placed into a ground in line away from said common junction and spaced apart a select distance of fourteen inches from each other to which each of said ground wires are attached, respectively.

2. The apparatus of claim 1 wherein there are four ground wires and four ground rods.

3. The apparatus of claims 1 or 2 wherein said ground wires and ground rods are made of copper.

4. A method for reducing electrical resistance in an electrical system, comprising the steps of:

Providing a plurality of electrically conductive ground wires having a common junction adapted to be attached to an electrical ground of an electrical meter of a building and having a parallel portion and angled portions and a selected distance between said ground wires of said parallel portion being two inches;

providing an equal number of electrically conductive ground rods placed into a ground in line away from said common junction and spaced apart a select distance of fourteen inches from each other; and attaching each of said ground wires to each of said ground rods, respectively.

5. The method of claim 4 wherein there are four ground wires and four ground rods.

6. The method of claims 4 or 5 wherein the ground wires and ground rods are made of copper.

* * * * *